US008540087B1

(12) United States Patent
Skaer

(10) Patent No.: US 8,540,087 B1
(45) Date of Patent: Sep. 24, 2013

(54) FOLDABLE HANGER DEVICE

(71) Applicant: Dean A. Skaer, Little Rock, AR (US)

(72) Inventor: Dean A. Skaer, Little Rock, AR (US)

( * ) Notice: Subject to any disclaimer, the term of this patent is extended or adjusted under 35 U.S.C. 154(b) by 0 days.

(21) Appl. No.: 13/840,846

(22) Filed: Mar. 15, 2013

(51) Int. Cl.
*A47F 7/00* (2006.01)
*A47G 29/00* (2006.01)

(52) U.S. Cl.
USPC .. 211/85.3; 248/282.1; 223/94; 211/119.004; 211/100

(58) Field of Classification Search
CPC ..... A47G 25/0685
USPC ..... 248/207, 218.4, 240, 282.1, 308, 248/276.1, 274.1, 309.1, 324; 223/85, 89, 223/94, 120, 88, DIG. 1; 211/116, 96–102, 211/197, 119.004, 119.009, 85.3; 224/313, 224/553; 16/223, 368, 369, 392
See application file for complete search history.

(56) References Cited

U.S. PATENT DOCUMENTS

| | | | | | |
|---|---|---|---|---|---|
| 269,171 | A | * | 12/1882 | Brickley | 211/96 |
| 472,188 | A | * | 4/1892 | Burdge | 211/97 |
| 954,920 | A | * | 4/1910 | Blandford | 211/99 |
| 975,273 | A | * | 11/1910 | Noppe | 211/97 |
| 999,283 | A | | 8/1911 | White | |
| 1,587,676 | A | * | 6/1926 | Patterson | 211/1.3 |
| 1,716,923 | A | * | 6/1929 | Lindquist | 211/104 |
| 1,751,198 | A | | 3/1930 | Franck | |
| 1,751,691 | A | * | 3/1930 | Flath | 248/213.1 |
| 2,162,919 | A | * | 6/1939 | McAuliffe et al. | 211/96 |
| 2,562,622 | A | * | 7/1951 | Laughlin | 211/100 |
| 2,626,714 | A | * | 1/1953 | Rover | 211/100 |
| 3,376,007 | A | * | 4/1968 | Chesterley | 248/285.1 |
| 3,724,677 | A | * | 4/1973 | Vogelhuber et al. | 211/96 |
| 3,825,127 | A | | 7/1974 | Morrison et al. | |
| 4,118,001 | A | | 10/1978 | Serkez | |
| 4,209,156 | A | | 6/1980 | Kashden | |
| 4,210,302 | A | | 7/1980 | Serkez | |
| 4,863,081 | A | * | 9/1989 | Gabbert | 224/550 |
| 5,348,260 | A | | 9/1994 | Acevedo | |
| 5,499,725 | A | * | 3/1996 | Palumbo | 211/105.1 |
| 6,715,718 | B1 | | 4/2004 | Chen et al. | |
| 6,871,749 | B2 | * | 3/2005 | Bostick et al. | 211/94.01 |
| 6,945,504 | B2 | | 9/2005 | Chen et al. | |
| 7,165,689 | B2 | * | 1/2007 | McDaniel | 211/165 |
| 7,806,280 | B1 | * | 10/2010 | Perkins et al. | 211/100 |
| 8,215,042 | B1 | * | 7/2012 | Kilmer | 40/757 |
| 2007/0098378 | A1 | | 5/2007 | Giacomuzzi | |
| 2010/0108834 | A1 | * | 5/2010 | Rigas | 248/213.1 |
| 2011/0233163 | A1 | | 9/2011 | Raddatz | |

* cited by examiner

*Primary Examiner* — Terrell McKinnon
*Assistant Examiner* — Michael McDuffie
(74) *Attorney, Agent, or Firm* — Richard Blakely Glasgow

(57) ABSTRACT

A hanger device includes a bracket; a first hanger arm having a top surface, wherein the top surface of the first hanger arm includes at least one notch, and wherein the first hanger arm is connected to the bracket via a first hinge; and a second hanger arm having a top surface, wherein the top surface of the second hanger arm comprises at least one notch, and wherein the second hanger arm is connected to the first hanger arm via a second hinge. The hanger arms may also include at least one eyelet.

9 Claims, 3 Drawing Sheets

FOLDABLE HANGER DEVICE

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

1. Field of the Invention

The present invention relates to a hanger device and more particularly to a foldable hanger device.

2. Brief Description of the Related Art

Many new homes are built with dedicated space, such as laundry rooms, where the homeowners can wash, dry, iron, and/or steam their clothes. Even so, a frequent issue faced is where to hang the clothes. Traditional rolling clothes racks and drying racks take up a large amount of space.

It would therefore be desirable to develop an easily storable, foldable, hanger device that can used to hang clothes and other items.

BRIEF SUMMARY OF THE INVENTION

The present invention is directed to a hanger device which includes: (a) a bracket; (b) a first hanger arm having a top surface, wherein the top surface of the first hanger arm includes at least one notch, and wherein the first hanger arm is connected to the bracket via a first hinge; and (c) a second hanger arm having a top surface, wherein the top surface of the second hanger arm comprises at least one notch, and wherein the second hanger arm is connected to the first hanger arm via a second hinge. The hanger arms may also include at least one eyelet.

These and other features, objects and advantages of the present invention will become better understood from a consideration of the following detailed description of the preferred embodiments and appended claims in conjunction with the drawings as described following:

DETAILED DESCRIPTION OF THE INVENTION

Figure 1:
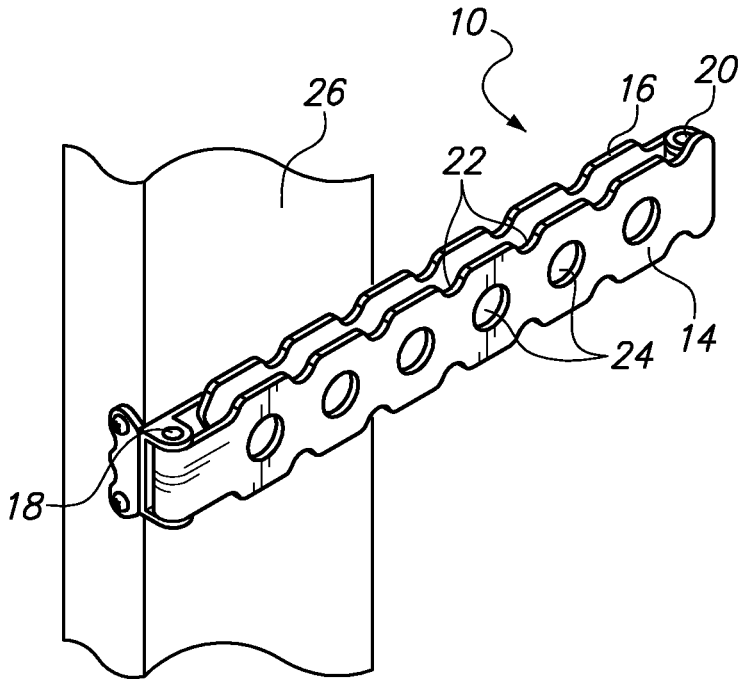
FIG. 1 is a perspective view of the first embodiment of the foldable hanger device in the first configuration.

With reference to FIGS. 1-4, the preferred embodiments of the present invention may be described. The foldable hanger device 10 includes a bracket 12, a first hanger arm 14, and a second hanger arm 16. The bracket is preferably of a type well-known to those skilled in the art and is connected to the first hanger arm 14 via a hinge 18. The first hanger arm 14 is connected on its other end to the second hanger arm 16 via a hinge 20. The hinges 18, 20 are preferably pin-type hinges and of a type well-known to those skilled in the art. The hinges 18, 20 allow a 180 degree range of motion of the arms 14, 16.

The first hanger arm 14 and second hanger arm 16 are preferably substantially rectangular-shaped, but may instead be of other suitable shapes. The top and bottom surfaces of the first hanger arm 14 and second hanger arm 16 include notches 22. The first hanger arm 14 and second hanger arm 16 also include eyelets 24 that extend through the arms 14, 16. The eyelets 24 are preferably staggered between the notches 22 along the centerline of the arms 14, 16. The notches 22 and eyelets 24 are shaped and sized to receive an object for hanging, such as the hooked end of a clothes hanger.

Figure 4:
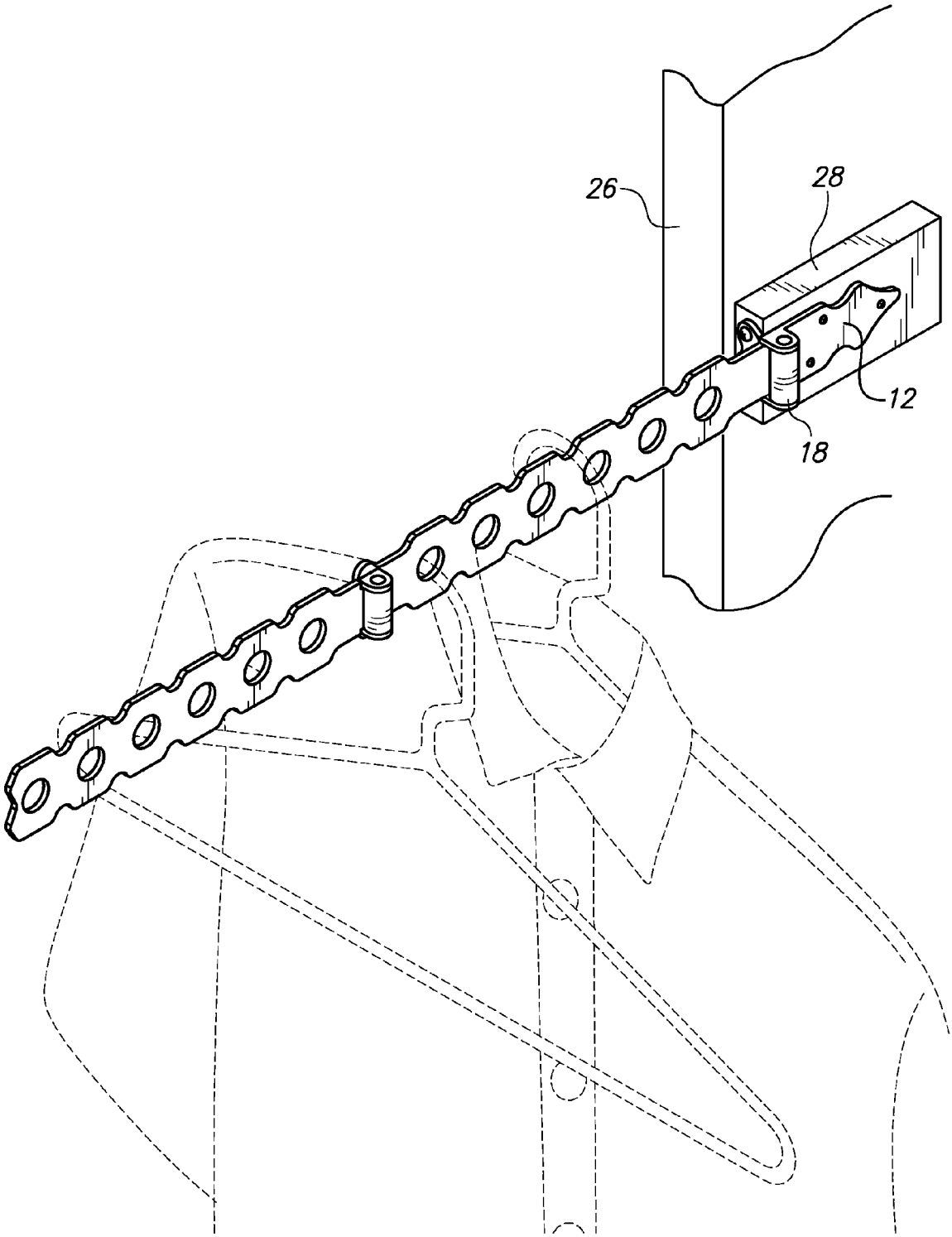
FIG. 4 is a perspective view of the second embodiment of the foldable hanger device in the third configuration.

To install the foldable hanger device 10, the bracket 12 is attached to any vertical surface of an object 26, such as the side of a cabinet or shelf. Because the device 10 includes notches on its top and bottom surfaces, the device 10 is versatile by being operable attached to either the right-hand side or left-hand side of the object 26. If the device 10 being attached directly to the object 26 would interfere with the functioning of the object 26, such as the opening and closing of cabinet doors, the bracket 12 may alternatively be attached to a mounting block 28 and the mounting block 28 attached to the object 26 via fasteners as shown in FIG. 4.

The hanger device 10 is operable in three configurations. The first configuration is utilized when the device is being stored and not in use. In this configuration, the device 10 is fully collapsed and positioned flushly along the side of the object 26. Specifically, as shown in FIG. 1, the second hanger arm 16 is positioned between and substantially parallel to the face of the bracket 12 and the first hanger arm 14.

Figure 2:
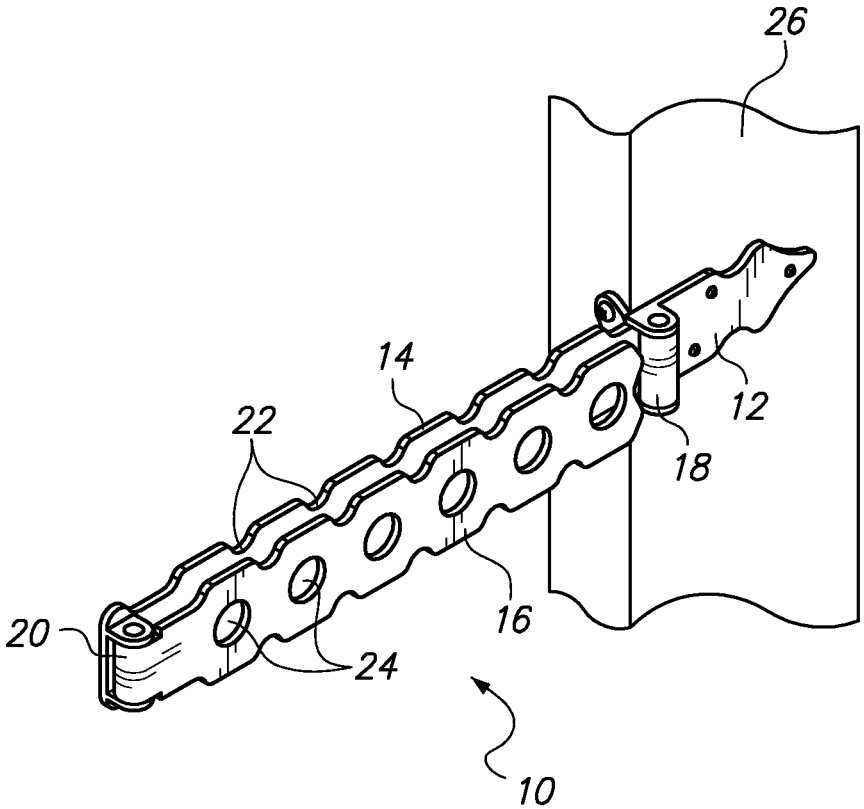
FIG. 2 is a perspective view of the first embodiment of the foldable hanger device in the second configuration.

The device is capable of being used to hang objects in both the second and third configurations. In the second configuration, as shown in FIG. 2, the first hanger arm 14 and the second hanger arm 16 are unfolded with respect to the face of the bracket 12, but the arms 14, 16 still remain positioned substantially parallel to one another. As a result of the unfolding, the arms 14, 16 are oriented 180 degrees from their position in the first configuration. The notches 22 and the eyelets 24 of the first hanger arm 14 and the second hanger arm 16 are aligned when the arms 14, 16 are folded substantially parallel to one another. As such, the device is functioning as a single hanger arm. The hooked end of a clothes hanger can be threaded through the aligned eyelets 24 of the first hanger arm 14 and second hanger arm 16. The hooked end of a clothes hanger may also be placed in the aligned notches 22 of the first hanger arm 14 and second hanger arm 20.

Figure 3:
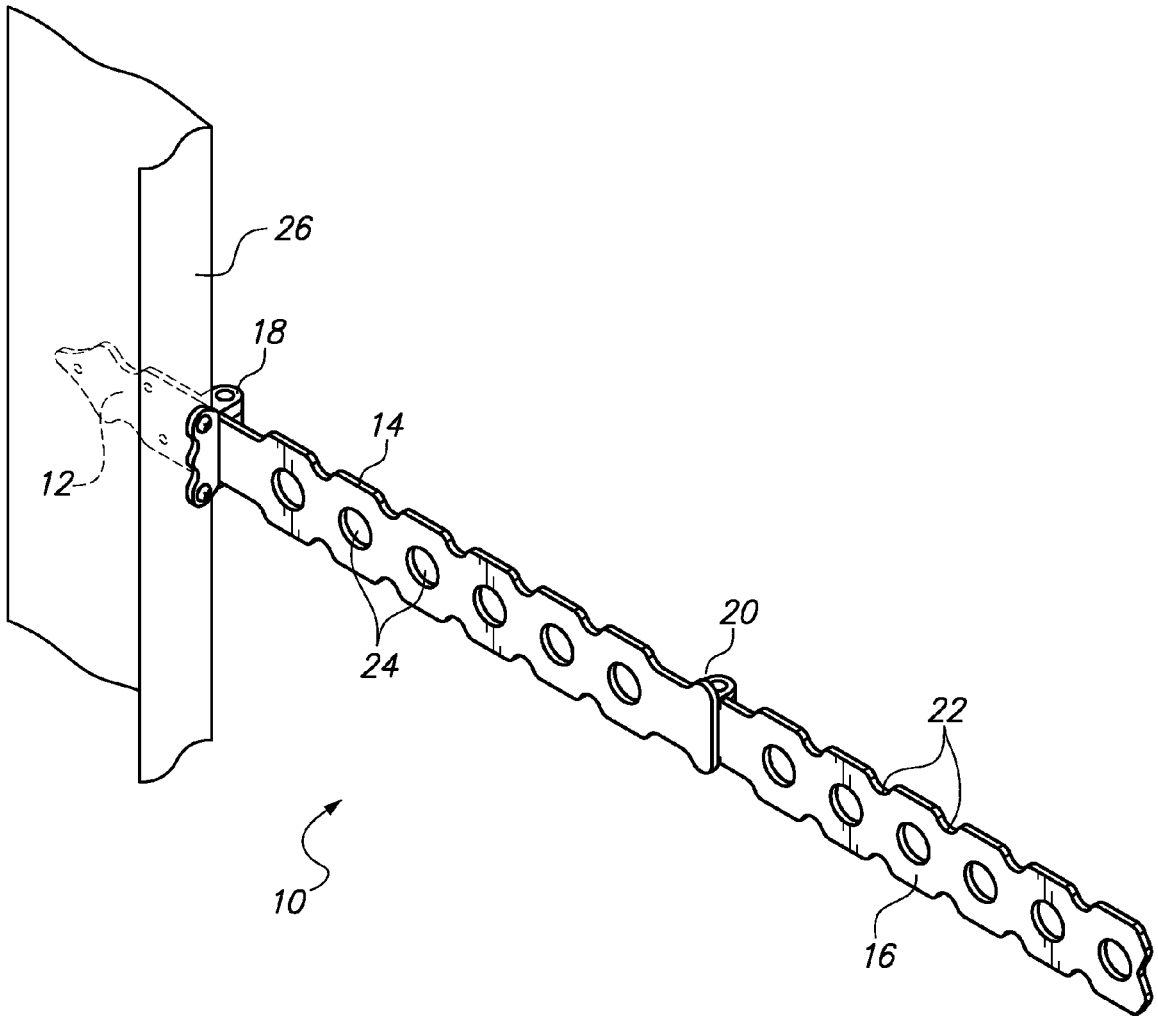
FIG. 3 is a perspective view of the first embodiment of the foldable hanger device in the third configuration.

When more notches 22 or eyelets 24 are needed for hanging objects, the third configuration may be preferable. In this configuration, the second hanger arm 16 is unfolded with respect to the first hanger arm 14. Thus, the second hanger arm 16 is positioned 180 degrees from its position in the second configuration. The face of the bracket 12, the first hanger arm 14, and the second hanger arm 16 are now aligned along their centerlines (i.e. end-to-end) as shown in FIG. 3. In other words, the bracket 12 and the first hanger arm 14 are positioned at a 0 degree angle with respect to one another. Likewise, the first hanger arm 14 and the second hanger arm 16 are positioned at a 0 degree angle with respect to one another. The foldable hanger arm 10 can be readily collapsed from the third configuration to the second configuration and from the second configuration to the first configuration.

The device 10 is preferably made of steel. The device 10 may alternatively be made of other materials (e.g. plastic, wood, fiberglass, or other metals) capable of supporting the hanging load on the device 10. The device 10 must also be sufficiently strong to avoid warping or fracturing as a result of extended use or temperature. The materials must also be capable of accepting paint.

As described above, the device 10 may be used to hang wet, freshly ironed, or dried clothing on conventional clothes hangers. It may also be utilized to hang freshly painted or other items in a workshop and other locations in a home or business.

The present invention has been described with reference to certain preferred and alternative embodiments that are intended to be exemplary only and not limiting to the full scope of the present invention as set forth in the appended claims.

I claim:

1. A hanger device comprising of:

(a) a bracket;

(b) a first hanger arm having a top surface and a bottom surface, wherein said top surface of said first hanger arm comprises at least one notch, wherein said bottom surface of said first hanger arm comprises at least one notch, and wherein said first hanger arm is connected to said bracket via a first hinge; and (c) a second hanger arm having a top surface and a bottom surface, wherein said top surface of said second hanger arm comprises at least one notch, wherein said bottom surface of said second hanger arm comprises at least one notch, and wherein said second hanger arm is connected to said first hanger arm via a second hinge.

2. The hanger device of claim 1, wherein said first hanger arm comprises at least one eyelet and said second hanger arm comprises at least one eyelet.

3. The hanger device of claim 1, wherein said hanger device has three configurations.

4. The hanger device of claim 1, wherein said bracket is positioned substantially parallel to said first hanger arm and said second hanger arm.

5. The hanger device of claim 1, wherein said at least one notch of said top surface of said first hanger arm and said at least one notch of said top surface of said second hanger arm are aligned, wherein said at least one notch of said bottom surface of said first hanger arm and said at least one notch of said bottom surface of said second hanger arm are aligned.

6. The hanger device of claim 2, wherein said at least eyelet of said first hanger arm and said at least one eyelet of said second hanger arm are aligned.

7. The hanger device of claim 1, wherein said bracket and said first hanger arm are connected at a 0 degree angle.

8. The hanger device of claim 1, wherein said first hanger arm and said second hanger arm are connected at a 0 degree angle.

9. The hanger device of claim 1, further comprising a mounting block.

* * * * *